US008554090B2

(12) United States Patent
Cachia et al.

(10) Patent No.: US 8,554,090 B2
(45) Date of Patent: Oct. 8, 2013

(54) REPLACEMENT PRINTER CARTRIDGE CHIP WITH A MICROCONTROLLER WITH AN ENCRYPTED MEMORY DEVICE

(75) Inventors: Joseph Cachia, Las Vegas, NV (US); Ken Segler, North Las Vegas, NV (US)

(73) Assignee: UI Technologies, Inc., Las Vegas, NV (US)

( * ) Notice: Subject to any disclaimer, the term of this patent is extended or adjusted under 35 U.S.C. 154(b) by 383 days.

(21) Appl. No.: 13/022,915

(22) Filed: Feb. 8, 2011

(65) Prior Publication Data

US 2011/0128567 A1 Jun. 2, 2011

Related U.S. Application Data

(63) Continuation-in-part of application No. 12/870,509, filed on Aug. 27, 2010.

(60) Provisional application No. 61/339,594, filed on Mar. 8, 2010, provisional application No. 61/280,049, filed on Oct. 30, 2009, provisional application No. 61/339,592, filed on Mar. 8, 2010.

(51) Int. Cl.
*G03G 15/00* (2006.01)

(52) U.S. Cl.
USPC ..... 399/12; 399/110; 399/111

(58) Field of Classification Search
USPC ..... 399/9, 12, 24–30, 109, 110, 119, 399/120; 347/6, 86; 235/492
See application file for complete search history.

(56) References Cited

U.S. PATENT DOCUMENTS

| | | | |
|---|---|---|---|
| 5,687,237 | A | 11/1997 | Naclerio |
| 5,892,826 | A | 4/1999 | Brown et al. |
| 6,098,888 | A | 8/2000 | Praden |
| 6,367,993 | B2 | 4/2002 | Day et al. |
| 6,402,032 | B1 | 6/2002 | Huang et al. |
| 6,490,420 | B2 | 12/2002 | Pollocks, Jr. |
| 6,792,536 | B1 | 9/2004 | Teppler |
| 6,832,730 | B2 | 12/2004 | Conner et al. |

(Continued)

FOREIGN PATENT DOCUMENTS

| | | |
|---|---|---|
| JP | 2004-126390 | 4/2004 |
| KR | 10-2004-0006406 | 1/2004 |
| KR | 10-2004-0020173 | 3/2004 |
| KR | 10-2005-0117796 | 12/2005 |

OTHER PUBLICATIONS

WIPO, Notification of Transmittal of the International Search Report and the Written Opinion of the International Searching Authority, or the Declaration, PCT/US2011/024586.

*Primary Examiner* — Hoan Tran
(74) *Attorney, Agent, or Firm* — Marc E. Hankin; Kevin Schraven; Hankin Patent Law, APC

(57) ABSTRACT

The invention is a replacement printed circuit board or chip that allows a printer to utilize a replacement printer cartridge. The printed circuit board has an encrypted memory device and a microcontroller, wherein the microcontroller is programmed to intercept the request from the printer for the unique lot number data and to provide the appropriate unique lot number data to the printer in response to the request. The encrypted memory device is programmed just like the custom original equipment manufacturer encrypted memory device, and, with the exception of providing the unique lot number data to the printer, communicates with the printer just as the original equipment manufacturer encrypted memory device would.

15 Claims, 7 Drawing Sheets

(56) References Cited

U.S. PATENT DOCUMENTS

| | | | | |
|---|---|---|---|---|
| 7,007,181 | B2 | 2/2006 | Yamada | |
| 7,187,874 | B1 | 3/2007 | Miller | |
| 7,286,774 | B1 | 10/2007 | Miller et al. | |
| 7,308,552 | B2 | 12/2007 | Hori | |
| 7,707,445 | B2 | 4/2010 | Gammel et al. | |
| 2006/0053269 | A1 | 3/2006 | Yoon et al. | |
| 2007/0160204 | A1 | 7/2007 | Kimura et al. | |
| 2007/0192831 | A1 | 8/2007 | Hashidate | |
| 2007/0223942 | A1* | 9/2007 | Miller | 399/12 |
| 2008/0050147 | A1* | 2/2008 | Burchette | 399/109 |

* cited by examiner

510

500

```
0000h: 3BB2 1100 1080 0002 2020 FFFF FFFF FFFF
0010h: 88C0 0000 0E68 DC80 FF53 4100 0000 6F2D
0020h: D63F D53F D53F D53F FFFF FFFF FFFF FFFF
0030h: FFFF FFFF FFFF FFFF FFFF FFFF FFFF FFFF
0040h: 0102 0200 FFFF FFFF 2530 FFFF FFFF 0801
0050h: FFA4 8183 F1AD 8B3F 351C 8C67 4C2B B0EB
0060h: FFFF FFFF FFFF FFFF FFFF FFFF FFFF FFFF
0070h: FFFF FFFF FFFF FFFF FFFF 7173 1510 FFFF
0080h: FFFF FFFF FFFF FFFF FFFF FFFF FFFF FFFF
0090h: E3A5 FFFF FFFF 592A FFFF FFFF FFFF FFFF
00A0h: FFFF FFFF FFFF FFFF FFFF FFFF DC80 FFFF
00B0h: FFFF FFFF FFFF 4641 58FF FFFF FFFF FFFF
00C0h: FFFF FFFF FFFF FFFF FFFF FFFF FFFF FFFF
00D0h: FFFF 1B72 53F6 FFFF FFFF FFFF FFFF FFFF
00E0h: FFFF FFFF FFFF FFFF FF1D D890 FFFF FFFF
00F0h: FFFF FFFF FFFF FFFF FFFF FFFF FFFF FFFF
```

Figure 4

610

600

```
0000h: FFFF FFFF FFFF FFFF FFFF FFFF FFFF FFFF
0010h: 1B72 F1AD 4641 B38C FFFF FFFF FFFF FFFF
0020h: FFFF FFFF FFFF FFFF FFFF FFFF FFFF FFFF
0030h: FFFF FFFF FFFF FFFF FFFF FFFF FFFF FFFF
0040h: FFFF FFFF FFFF FFFF FFFF FFFF FFFF FFFF
0050h: FFFF FFFF FFFF FFFF FFFF FFFF FFFF FFFF
0060h: FFFF FFFF FFFF FFFF FFFF FFFF FFFF FFFF
0070h: FFFF FFFF FFFF FFFF FFFF FFFF FFFF FFFF
0080h: FFFF FFFF FFFF FFFF FFFF FFFF FFFF FFFF
0090h: FFFF FFFF FFFF FFFF FFFF FFFF FFFF FFFF
00A0h: FFFF FFFF FFFF FFFF FFFF FFFF FFFF FFFF
00B0h: FFFF FFFF FFFF FFFF FFFF FFFF FFFF FFFF
00C0h: FFFF FFFF FFFF FFFF FFFF FFFF FFFF FFFF
00D0h: FFFF FFFF FFFF FFFF FFFF FFFF FFFF FFFF
00E0h: FFFF FFFF FFFF FFFF FFFF FFFF FFFF FFFF
00F0h: FFFF FFFF FFFF FFFF FFFF FFFF FFFF FFFF
```

Figure 5

REPLACEMENT PRINTER CARTRIDGE CHIP WITH A MICROCONTROLLER WITH AN ENCRYPTED MEMORY DEVICE

CROSS-REFERENCE TO RELATED APPLICATIONS

This Application is a Continuation-in-Part of U.S. Non-Provisional Patent Application No. 12/870,509, filed on Aug. 27, 2010, titled "Replacement Smart Card With A Microcontroller" by inventors Joseph M. Cachia and Ken Segler, which itself claims priority to U.S. Provisional Patent Application Nos. 61/339,594, filed on Mar. 8, 2010, and 61/280,049, filed on Oct. 30, 2009, the contents of all three Applications are expressly incorporated herein by this reference, and to which priority is claimed. Priority is also claimed to U.S. Provisional Patent Application Ser. No. 61/339,592, filed on Mar. 8, 2010, titled "Replacement Printer Cartridge Chip Utilizing a Microcontroller with an Encryption Module" by inventors Joseph M. Cachia and Ken Segler, the contents of which are expressly incorporated herein by this reference.

BACKGROUND OF THE INVENTION

This invention relates to a replacement printer cartridge chip, and more specifically to a replacement printer cartridge chip that utilizes a microcontroller with an encrypted module that enables operation of a replacement imaging device cartridge.

Currently, most imaging devices, such as printers, copiers, faxes and multi-function machines, utilize user-replaceable cartridges that contain the printing media, usually toner, which is a dry ink, or liquid ink. Replacement cartridges replenish the toner or ink supply and allow the continuing ability to print high quality documents and images when the previous cartridge has been depleted. Historically, once the previous cartridge was removed from the printer, it was considered office trash and it was discarded. The cartridges were, generally, very durable and they were capable of continuing to provide excellent print quality. However, without an ink or toner supply, the cartridges were effectively useless. Some years ago, an industry of remanufacturers developed to collect these spent cartridges and remanufacture them to like-new condition.

Traditionally, the cartridges were disassembled, cleaned, damaged parts are replaced, and the toner or ink supply replenished. In recent years however, the original equipment manufacturers (OEMs) equipped these cartridges with a small circuit board, also called a "chip." The purpose of the chip is to allow the printing machine to record information relevant to the cartridge such as printer model, pages printed, or toner remaining, onto the chip. When the toner is depleted, the chip is "closed" and does not allow any further use from that cartridge, regardless of whether the cartridge is replenished with ink or toner. In other words, once the initial toner or ink runs out and the chip is closed, the cartridge cannot be reused, even after remanufacturing. Thus, a replacement chip must be installed on to the cartridge, otherwise the printing machine would see the replenished or remanufactured cartridge with a "toner low" or "toner out" condition. The purpose for adding these chips is that the printer manufacturers design their printers to accept toner cartridges that they have manufactured themselves and to reject the toner cartridges manufactured or remanufactured by others. This allows printer manufacturers to prevent others from selling new or remanufactured printer cartridges that will work in their printers. As such, the OEMs have a monopoly over the production of replacement printer cartridge chips for their printer, which allows them to increase sales of their own toner cartridges.

In order to provide a fully functioning remanufactured replacement cartridge, remanufacturers must now include a replacement chip. These chips by design must emulate the physical fit and functionality of the OEM chips to provide error-free usage. These replacement, or aftermarket, chips at one time were developed by a number of companies.

Eventually, the OEMs developed chips that included an encrypted memory device containing critical data that was used as a key component on the cartridge IC to hinder aftermarket development of replacement chips. For this encrypted memory to work, it must be opened or unlocked by use of a password in order to access the data. Without the passwords, the encrypted memory device on OEM Integrated Circuit (IC) cannot be read or written to and the chip will not work. Further, the password is needed in order to have a functional replacement chip. Although it was difficult for remanufacturers or after market suppliers to determine the passwords, it was not impossible, and through careful analysis and the commercial availability of encrypted memory devices, the passwords have been determined. With the working passwords, after market manufacturers created fully functional replacement chips.

The resource capabilities of the OEMs enabled them to develop custom encrypted memory devices, which are not commercially available. This additional encryption did not make the product any better and was done exclusively to uncompetitively delay or even prevent the development of aftermarket chips that would enable cartridge remanufacturing. Specifically, in addition to a unique password, the replacement chip memory must also include a unique lot identification number. This number is located in a non-accessible, non writable portion of the encrypted memory device, which makes had made it impossible for aftermarket chip manufacturers to present or return the correct lot identification number to the machine to enable operation. In order to provide a fully functional remanufactured replacement cartridge, the remanufacturers require a replacement cartridge chip that returns the unique lot identification number when requested or needed by the printing device. Without properly programmed cartridge chips, the remanufactured cartridges do not function.

Thus, there is a need for a remanufactured printer chip that has a microcontroller, wherein the microcontroller is used in conjunction with an encrypted memory device that emulates the function of the custom OEM encrypted memory device to enable operation of a replacement printer cartridge. Although microcontrollers are commonly used in replacement cartridge chips, no replacement printer cartridge chip has ever combined a microcontroller in conjunction with an encrypted memory device to enable a replacement printer cartridge to function.

SUMMARY OF THE INVENTION

Various embodiments of the invention are directed towards overcoming the above deficiencies of the prior art by providing a replacement printer chip that utilizes a microcontroller in conjunction with the with an encrypted memory device, typically an IC, to allow a user to produce a working remanufactured printer cartridge. The replacement printer chip, or printed circuit board, includes a commercially available encrypted memory device that is programmed to emulate the function of the OEM custom encrypted memory device. The replacement printer chip communicates with the printing machine through the encrypted memory device except when a query is sent for the unique lot code. When such a query is sent for the unique lot code, the microcontroller inserts the correct, anticipated lot code into the data stream. This satisfies the printing machine, which then accepts and interoperates with the remanufactured printer cartridge to which the replacement printer chip is attached.

One embodiment of the invention is a replacement printer cartridge chip comprising: a printed circuit board. The printed circuit board is attached to a replacement printer cartridge. The printed circuit board is preferably comprised of an encrypted memory device, a microcontroller, one or more contacts, and one or more supporting components. The replacement printer cartridge is inserted into the printer. The contacts engage with one or more printer contacts when the printer cartridge is inserted into the printer. This allows the printer to send and receive communications with the printed circuit board. The printer sends and receives one or more communications to and from said printed circuit board. The microcontroller monitors the communications from said printer. The printer sends a request for a unique lot number data to the printed circuit board. The microcontroller senses when the printer sends the request for the unique lot number data and directs the request to the microcontroller. The microcontroller then blocks the request from reaching said encrypted memory device. The microcontroller is preferably programmed with the unique lot number data and returns the unique lot number data to the printer, which allows the printer to interoperate with the printed circuit board. The encrypted memory device is preferably programmed with a set of data that is specific to a particular type of printer and is substantially similar to an original equipment manufacturer set of data except for the unique lot number data. The encrypted memory device functions the same as a custom original equipment manufacturer encrypted memory device and accepts one or more communications from said printer except for the request for said unique lot number data.

Another embodiment of the invention is a method of enabling interoperation between a replacement printer cartridge and a printer comprising the steps of: providing a printer; providing a replacement printer cartridge; providing a printed circuit board; wherein the printed circuit board is attached to the replacement printer cartridge; wherein the printer has a cavity that accepts the replacement printer cartridge; wherein the replacement printed circuit board allows for utilization of the replacement printer cartridge by the printer; wherein the printed circuit board is preferably comprised of an encrypted memory device, a microcontroller, and one or more contacts; inserting the replacement printer cartridge into the printer cavity; wherein the one or more contacts engage with one or more printer contacts; sending and receiving communications by said printer with the printed circuit board; evaluating by said microcontroller the communications from the printer; requesting by the printer a unique lot number data from the encrypted memory device; blocking the encrypted memory device from providing said unique lot number data; wherein the microcontroller is programmed with the unique lot number data; and returning the unique lot number data to said printer by said microcontroller.

Preferably the method of enabling interoperation between a replacement printer cartridge and a printer further comprises the steps of: programming the encrypted memory device with a set of data; wherein the set of data is specific to a particular type of printer and is substantially similar to an original equipment manufacturer set of data except for the unique lot number data; wherein the encrypted memory devices functions as a custom original equipment manufacturer encrypted memory device and accepts all of the one or more communications from the printer except for the request for the unique lot number data.

In the present invention the microcontroller is used in conjunction with an original, commercially available encrypted memory device previously used in earlier versions of the OEM cartridge chips. A printed circuit board allows the machine to communicate with the encrypted memory device, except when querying the unique lot code required allowing function. At that point, the microcontroller will insert the correct, anticipated lot code into the data stream, and satisfy the printing machine query.

The commercially available encrypted memory device, which is part of the replacement cartridge chip, is programmed with the specific data to allow interoperation with the respective printing machine with which it is intended to be used. The replacement cartridge chip essentially functions as a normal OEM chip and it is installed into the replacement cartridge and, if necessary, the replacement cartridge chip has exposed contact pads, which make the proper connection with the printing machine.

The replacement cartridge chip of the present invention works because it contains a circuit that connects the encrypted memory device, the microcontroller, and supporting components, and together these parts work to allow communication between the printing machine and the replacement cartridge chip.

At power-up, the printing machine typically queries the cartridge chip, to check to make sure that the cartridge chip is an OEM chip, and thus prevent users from using a competitive after market replacement cartridge. If the query does not return the appropriate information, such as the unique lot code, the printing device will not accept or utilize the replacement cartridge. This allows the printing machine OEM to have a monopoly on replacement cartridges for the printing machine. This monopoly is uncompetitive and inevitably leads to the user paying far more than he or she should for a replacement printer cartridge. The present invention provides a solution to users having to pay monopoly prices for replacement printer cartridges. When the response to the printing machine from the cartridge chip reaches the specific memory locations of the unique lot code, the microcontroller blocks the data from the encrypted memory device, and substitutes the correct unique lot number to the machine. The microcontroller is programmed with the correct numbers and locations.

The microcontroller is programmed to evaluate the communication from the machine to the encrypted memory device. When the printing machine looks for the unique OEM unique lot number, the microcontroller will block the encrypted memory device from returning a response that will disable interoperation between the machine and the cartridge, and instead, the microcontroller submits the correct OEM lot number to initiate function. The encrypted memory device functions as normal when communicating with the machine in all other aspects and accepts reads and writes as required. The encrypted memory device cannot return the correct lot code on its own because the data at the location in the memory containing the unique lot code is simply the wrong data.

The encrypted memory device is preferably an integrated circuit (IC).

In this invention, the microcontroller is preferably used in conjunction with an encrypted memory device and both are mounted on the printer cartridge chip or printed circuit board. The printed circuit board of the present invention preferably has exposed contacts, which are similar to the original chip contacts, and allows the replacement printer cartridge chip to make a connection when the cartridge is inserted into the printing machine.

Alternatively, the printed circuit board of the present invention may have no exposed contacts, instead communicating with the machine via a radio frequency ("RF") signal, or some other device, as required for the particular type and style of the imaging machine. In the present invention the communication means of the receiver/transponder are preferably imbedded within the replacement chip.

An object of the present invention is to provide a functional replacement printer cartridge and replacement printer cartridge chip that overcomes the limitations of the prior art.

Another object of the present invention is to provide a replacement printer cartridge chip that allows the user to use a remanufactured printer cartridge for a printer.

Another object of the present invention is to provide a replacement printer cartridge chip that allows interoperation between a replacement printer cartridge and a printer.

Another object of the present invention is to provide a replacement printer cartridge chip with a microcontroller, an encrypted memory device, and an integrated circuit that provides all of the information needed to allow the replacement printer cartridge chip to communicate with the printer model or models for which the original encrypted memory device was made.

Other features and advantages are inherent in the replacement smart card claimed and disclosed will become apparent to those skilled in the art from the following detailed description and its accompanying drawings.

BRIEF DESCRIPTION OF THE DRAWINGS

FIG. 4 is a diagram of a data table of an original equipment manufacturer encrypted memory device.

FIG. 5 is a diagram of a data table of a blank encrypted memory device.

DETAILED DESCRIPTION OF THE DRAWINGS

In the following detailed description of the various embodiments of the invention, numerous specific details are set forth in order to provide a thorough understanding of various embodiments of the invention. However, one or more embodiments of the invention may be practiced without these specific details. In other instances, well-known methods, procedures, and/or components have not been described in detail so as not to unnecessarily obscure aspects of embodiments of the invention.

In the following detailed description of the various embodiments of the invention, reference is made to the accompanying drawings that form a part hereof, and in which is shown by way of illustration a specific embodiment in which the invention may be practiced. It is to be understood that other embodiments may be utilized and structural changes may be made without departing from the scope of the present invention. Accordingly, the drawings and detailed description are to be regarded as illustrative in nature and not restrictive. In addition, the reference or non-reference to a particular embodiment of the invention shall not be interpreted to limit the scope of the invention.

In the following description, certain terminology is used to describe certain features of one or more embodiments of the invention. For instance "printer" refers to any image forming device that accepts the use of an ink or toner cartridge, including, but not limited to printers, copiers, facsimiles, or machines that combine printing, copying, and faxing. "Microcontroller" is any system, device, or execution unit with functionality capable of enabling the communications, compatibility, and interoperations described herein. The "microcontroller" is capable of storing information, receiving signals, including those signals received from an outside source, such as a printer, and transmitting signals. Preferably the "microcontroller" is a single integrated circuit. A "printer cartridge" is a replaceable ink or toner cartridge that is accepted into a "printer" The term "printed circuit board" refers to an integrated circuit, integrated circuit board, or chip, that has contacts or is contactless. The printed circuit board might typically include a printed circuit, supporting components, integrated circuits or chips, microcontrollers, and communications components. The supporting components can be any component attached to a circuit board, including but not limited to resistors, capacitors, chips, diodes, and transistors. The communications components may include, but are not limited to contacts and radio frequency devices.

Figure 1:
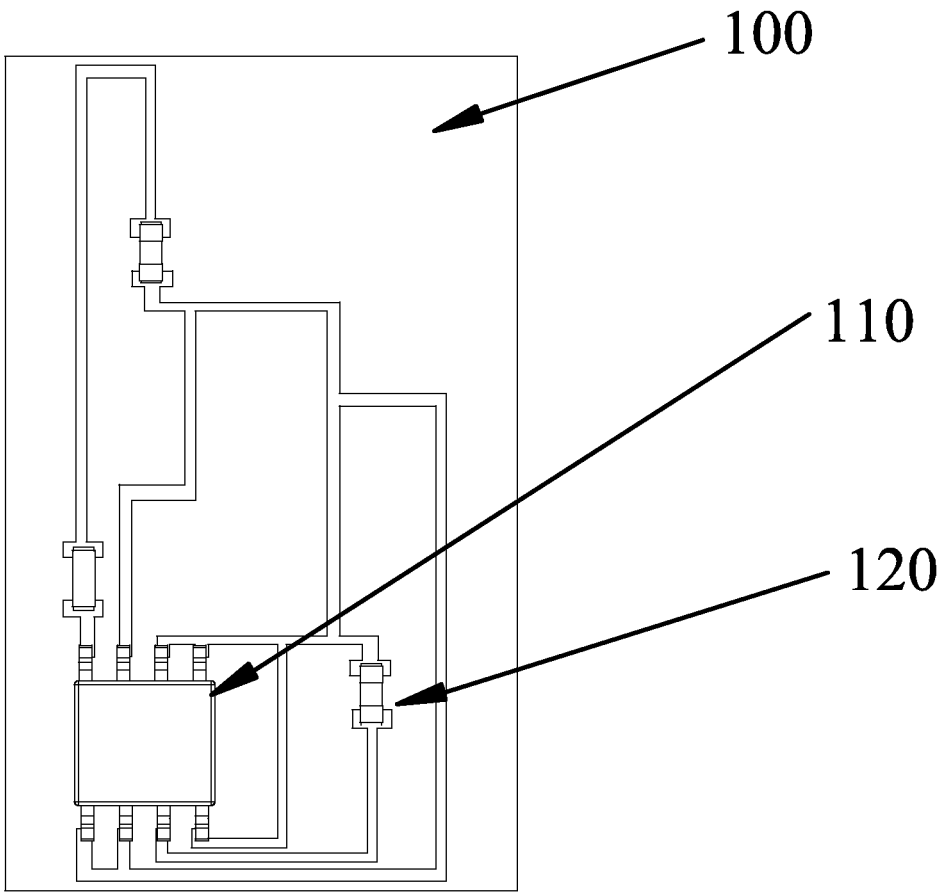
(Prior Art) Figure 1
FIG. 1 is an illustration of a front view of a prior art printer chip.

FIG. 1 is an illustration of a front view of a prior art printer chip. As shown in FIG. 1, the typical prior art printer chip 100 has an imbedded encrypted memory device 110 and supporting components 120. Typically the encrypted memory device 110 is an integrated circuit that has a memory. The encrypted memory device 110 is encrypted so that the unique lot code number cannot be changed, read, or accessed. This prevents aftermarket chip manufacturers from creating a chip wherein the unique lot code number is reprogrammed or changed to have a lot code that is recognized as valid by a desired printer. Without the appropriate unique lot code that is custom to the printer OEM, the printer will not interoperate with the chip and the printer cartridge to which it is attached.

Figure 2:
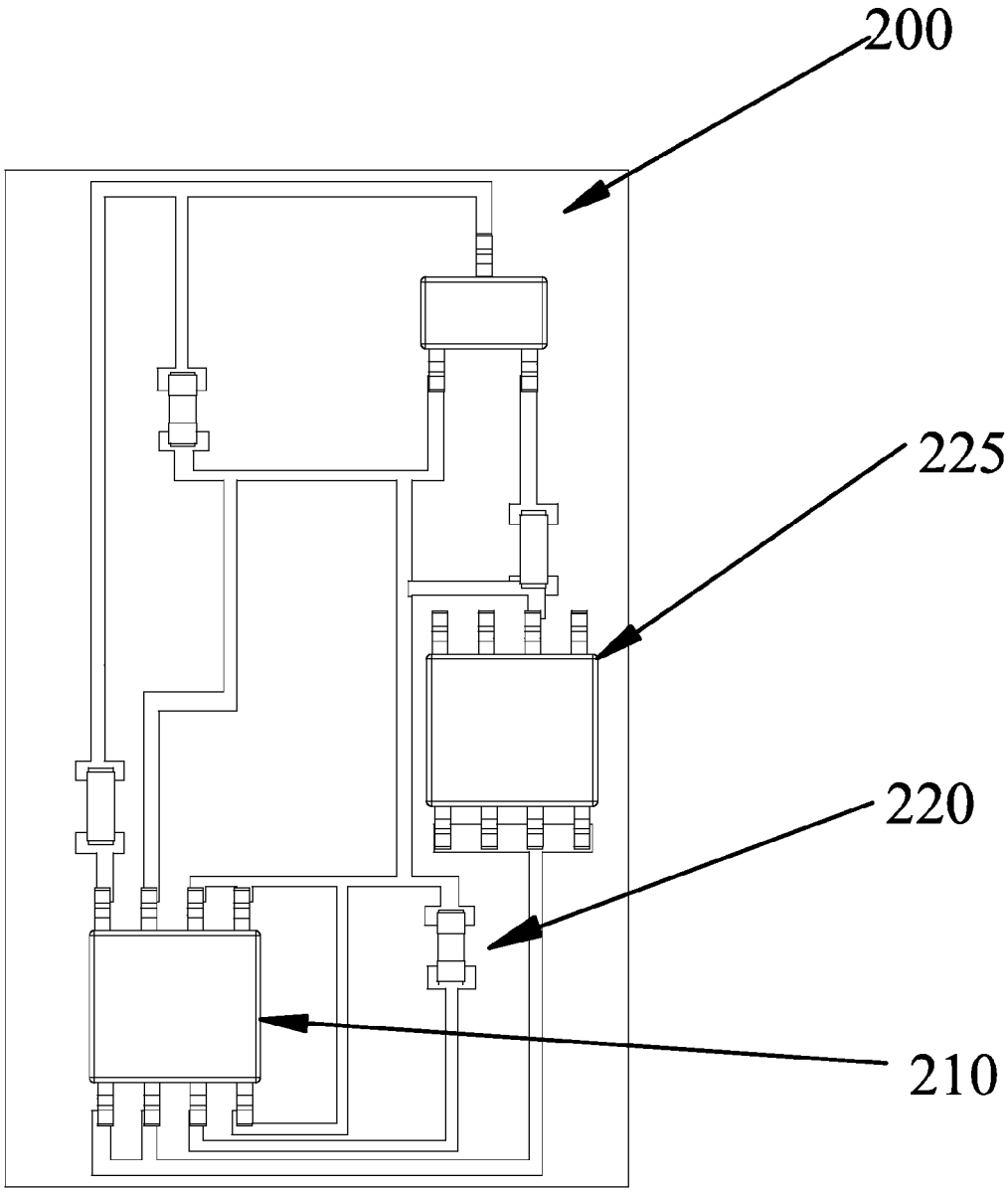
FIG. 2 is an illustration of a front view of one embodiment of the invention.

FIG. 2 is an illustration of a front view of one embodiment of the invention. As shown in FIG. 2, the printed circuit board 200 of the present invention preferably includes: an encrypted memory device 210, supporting components 220; and microcontroller 225. The printed circuit board 200 is a replacement chip, integrated circuit, or printed circuit board that is designed to allow interoperation between a printer and a replacement printer cartridge, to which the replacement printed circuit board is attached. The printed circuit board 200 is preferably has the same shape and thickness of the custom OEM chip 100, so that it can engage a printer in the same manner as the OEM chip does.

Figure 3:
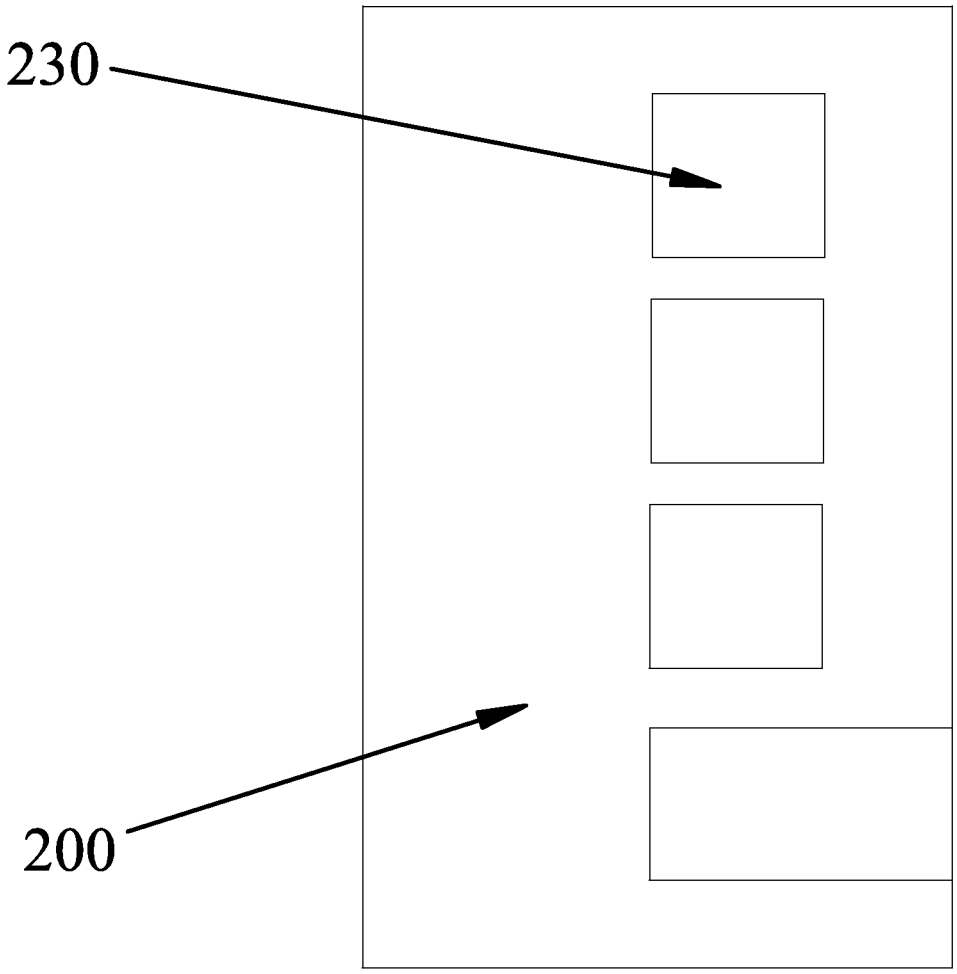
FIG. 3 is an illustration of a back view of one embodiment of the invention.

FIG. 3 is an illustration of a back view of one embodiment of the invention. As shown in FIG. 3, the printed circuit board 200 preferably includes exposed contacts 230 such that when the printed circuit board 200 is placed on a replacement printer cartridge, and the replacement printer cartridge is inserted into a printer, the exposed contacts 230 engage with the exposed contacts of the printer. This connection allows the printer to communicate with the printed circuit board 200. It should be understood that the printed circuit board 200 may communicate with the printer using any device or may have a contactless engagement mechanism, such as a radio frequency device. Typically, with a contactless system, both the printer and the printed circuit board 200 have antennae and receivers and the two communicate using radio frequency over a contactless or wireless link.

Once the printed circuit board 200 is in communication with the printer, the communications will be transmitted to the encrypted memory device 210 and microcontroller 225. The encrypted memory device 210 is preferably programmed with the specific data for the respective printer with which it will be in communication. The encrypted memory device 210 is preferably commercially available and, after programming, in almost all respects identical, or substantially similar to, the custom OEM encrypted memory device 110 that would normally be attached to the new printer cartridge made by the printer OEM.

However, the typical commercially available encrypted memory device has a locked standard lot number (as shown in FIG. 4), which is also called the unique lot number data. This locked lot number cannot be reprogrammed or overwritten. As such, the encrypted memory device 210 cannot be programmed to have a different unique lot number data. Therefore, when the printer requests from the encrypted memory device 210 the information stored at the locked standard lot number location, the information returned from the encrypted memory device 210 would be incorrect and the printed circuit board 200 would not enable interoperation between the printer and the replacement printer cartridge.

The microcontroller 225 monitors the communications from the printer into which the replacement printer cartridge was inserted and it intercepts communications that request information stored at the locked standard lot number location. In this manner, the encrypted memory device 210 is blocked from receiving and responding to this specific request. However, preferably, all other communications between the printer and the encrypted memory device 210 are not blocked and the encrypted memory device 210 accepts all reads and writes from the printer, just as an original equipment manufacturer encrypted memory device 110 would do. Once the request for the unique lot number data has been intercepted, the microcontroller 225 returns the appropriate unique lot number data to the printer to enable interoperation of the printer and the replacement printer cartridge. The microcontroller 225 has preferably been programmed with the appropriate unique lot number data that the printer will accept.

FIG. 4 is a diagram of a data table of an original equipment manufacturer encrypted memory device. As shown in FIG. 4, the original equipment manufacturer integrated circuit data table 500 has a unique lot number 510 at a specific location. In this case, the location is "0010h". This unique lot number 510 data is specific to the original equipment manufacturer and cannot be duplicated or imprinted upon another encrypted memory device. FIG. 4 shows how some of the locations of data table 500 are populated and others are blank ("FFFF").

FIG. 5 is a diagram of a data table of a blank encrypted memory device. As shown in FIG. 5, a commercially available blank encrypted memory device has an integrated circuit data table 600, which has a unique lot number 610 at a specific location. In this case, the location is "0010h". Preferably, as shown in FIG. 5, the blank integrated circuit data table 600 is substantially unpopulated with data.

Figure 6:
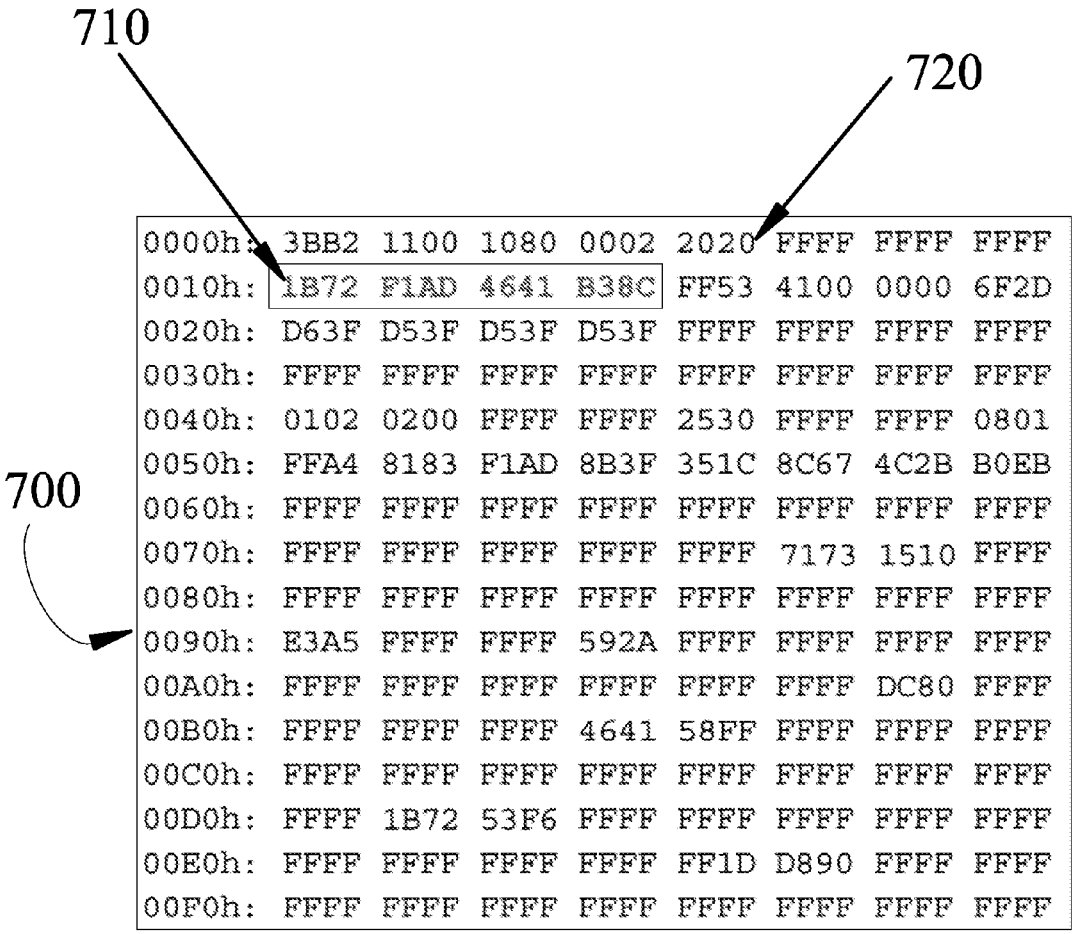
FIG. 6 is a diagram of a data table of one embodiment of the invention.

FIG. 6 is a diagram of a data table of one embodiment of the invention. As shown in FIG. 6, the encrypted memory device 210 (shown in FIG. 2) has a data table 700 that, with the exception of the unique lot number 710, is identical or substantially similar to data table 500 (as shown in FIG. 4). For example, the data in the seventh Colum of location "00A0h" is "DC80" in both data table 700 (as shown in FIG. 6) and data table 500 (as shown in FIG. 4). In this manner, the encrypted memory device 210 is able to communicate with and interoperate with the designated printer, for all queries except the unique lot code.

Figure 7:
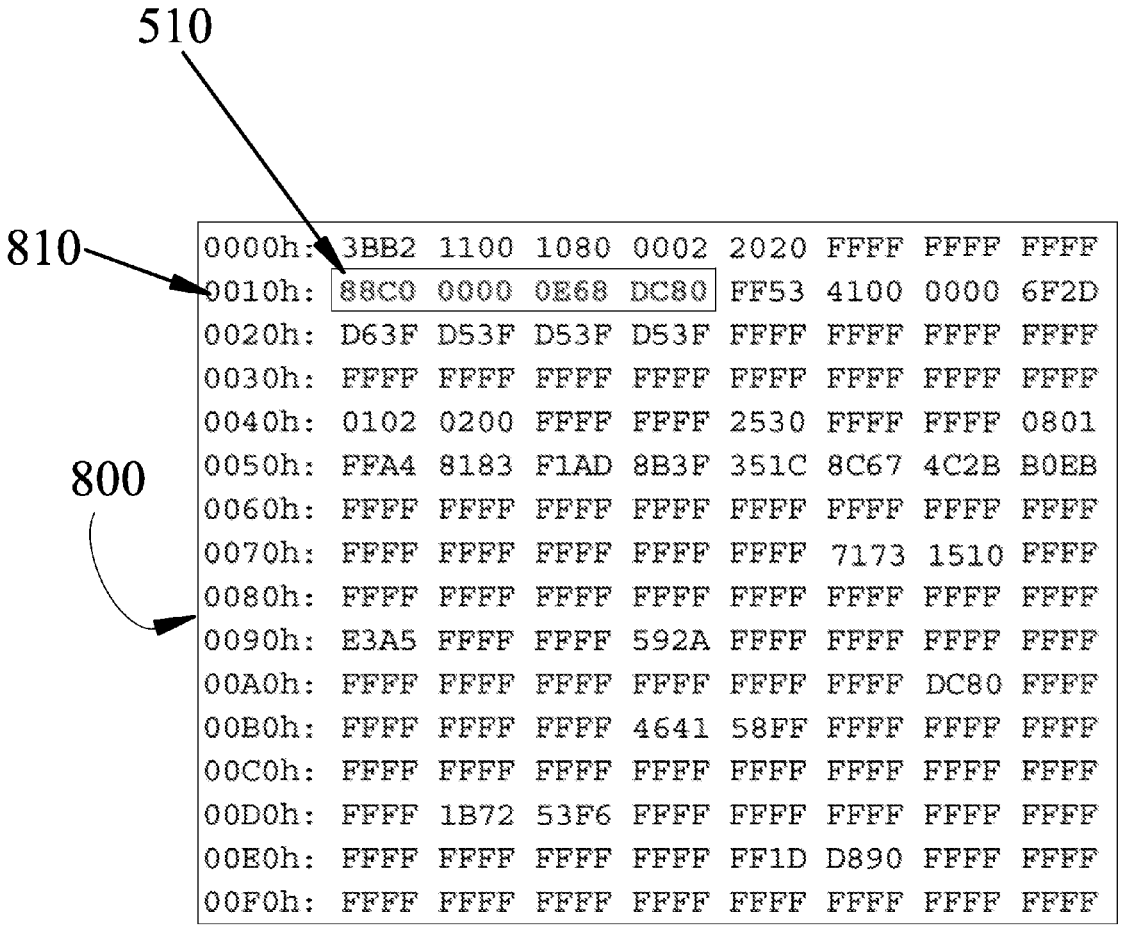
FIG. 7 is a diagram of a functional data table of one embodiment of the invention and shows how the microcontroller provides the unique lot number data.

FIG. 7 is a diagram of a functional data table of one embodiment of the invention and shows how the microcontroller provides the unique lot number data. FIG. 7 shows data table 800 as it essentially functions with a printer. Specifically, when the printer requests information from the unique lot number location 810, the microcontroller functions to provide the unique lot number data 510 to the printer. Thus, although the data table 800 of the encrypted memory device 210 of the present invention is not actually programmed with the unique lot number data 510, the printer believes it is and accepts the appropriate unique lot number as provided by the microcontroller.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope of the invention. It is intended that the scope of the invention not be limited by this detailed description, but by the claims and the equivalents to the claims that are appended hereto.

We claim:

1. A replacement printer cartridge chip comprising:

a printed circuit board;

wherein said printed circuit board is attached to a replacement printer cartridge;

wherein said printed circuit board is comprised of an encrypted memory device and a microcontroller;

wherein said printed circuit board engages with a printer when said replacement printer cartridge is inserted into said printer;

wherein said printer sends and receives one or more communications to and from said printed circuit board;

wherein said printed circuit board monitors one or more communications sent from said printer to said printed circuit board;

wherein said printer sends a request for a unique lot number data to said printed circuit board;

wherein said printed circuit board senses when said printer sends said request for said unique lot number data and directs said request to said microcontroller; and wherein said microcontroller is programmed with said unique lot number data and returns said unique lot number data to said printer, which allows said printer to interoperate with said printed circuit board.

2. The replacement printer cartridge chip of claim 1, wherein said microcontroller monitors and senses said one or more communications from said printer;

wherein said microcontroller blocks said request for said unique lot number data from said printer from reaching said encrypted memory device;

wherein said microcontroller returns said unique lot number from a memory of said microcontroller to said printer.

3. The replacement printer cartridge chip of claim 2, wherein said printed circuit board further comprises:

one or more contacts;

wherein said one or more contacts engage with one or more printer contacts when said printer cartridge is inserted into said printer, which allows said printer to send and receive said one or more communications with said printed circuit board.

4. The replacement printer cartridge chip of claim 3, wherein said encrypted memory device is programmed with a set of data.

5. The replacement printer cartridge chip of claim 4, wherein said set of data is specific to a particular type of printer and is substantially similar to an original equipment manufacturer set of data except for said unique lot number data.

6. The replacement printer cartridge chip of claim 5, wherein said encrypted memory device functions as a custom original equipment manufacturer encrypted memory device and accepts all of said one or more communications from said printer except for said request for said unique lot number data.

7. The replacement printer cartridge chip of claim 6, wherein said printed circuit board further comprises:

one or more supporting components.

8. The replacement printer cartridge chip of claim 1, wherein said printed circuit board further comprises:

one or more contacts;

wherein said one or more contacts engage with one or more printer contacts when said printer cartridge is inserted into said printer, which allows said printer to send and receive said one or more communications with said printed circuit board.

9. The replacement printer cartridge chip of claim 1, wherein said printed circuit board further comprises:

one or more supporting components.

10. The replacement printer cartridge chip of claim 1, wherein said encrypted memory device is programmed with a set of data.

11. The replacement printer cartridge chip of claim 10, wherein said set of data is specific to a particular type of printer and is substantially similar to an original equipment manufacturer set of data except for said unique lot number data.

12. The replacement printer cartridge chip of claim 11, wherein said encrypted memory device functions as a custom original equipment manufacturer encrypted memory device and accepts all of said one or more communications from said printer except for said request for said unique lot number data.

13. A replacement printer cartridge chip comprising:

a printed circuit board;

wherein said printed circuit board is attached to a replacement printer cartridge;

wherein said printed circuit board is comprised of an encrypted memory device, a microcontroller, one or more contacts, and one or more supporting components;

wherein said replacement printer cartridge is inserted into said printer;

wherein said one or more contacts engage with one or more printer contacts when said printer cartridge is inserted into said printer, which allows said printer to send and receive said one or more communications to and from said printed circuit board;

wherein said printer sends and receives one or more communications to and from said printed circuit board;

wherein said microcontroller monitors said one or more communications from said printer;

wherein said printer sends a request for a unique lot number data to said printed circuit board;

wherein said microcontroller senses when said printer sends said request for said unique lot number data and directs said request to said microcontroller;

wherein said microcontroller blocks said request for said unique lot number data from said printer from reaching said encrypted memory device;

wherein said microcontroller is programmed with said unique lot number data and returns said unique lot number data to said printer, which allows said printer to interoperate with said printed circuit board;

wherein said encrypted memory device is programmed with a set of data;

wherein said set of data is specific to a particular type of printer and is substantially similar to an original equipment manufacturer set of data except for said unique lot number data; and wherein said encrypted memory device functions as a custom original equipment manufacturer encrypted memory device and accepts one or more communications from said printer except for said request for said unique lot number data.

14. A method of enabling interoperation between a replacement printer cartridge and a printer comprising the steps of:

providing a printer;

providing a replacement printer cartridge;

providing a printed circuit board;

wherein said printed circuit board is attached to said replacement printer cartridge;

wherein said printer has a cavity that accepts said replacement printer cartridge;

wherein said replacement printed circuit board allows for utilization of said replacement printer cartridge by said printer;

wherein said printed circuit board is comprised of an encrypted memory device, a microcontroller, and one or more contacts;

inserting said replacement printer cartridge into said printer cavity;

wherein said one or more contacts engage with one or more printer contacts;

sending and receiving communications by said printer with said printed circuit board;

evaluating by said microcontroller said one or more communications from said printer;

requesting by said printer a unique lot number data from said encrypted memory device;

blocking said encrypted memory device from providing said unique lot number data;

wherein said microcontroller is programmed with said unique lot number data;

returning said unique lot number data to said printer by said microcontroller.

15. The method of enabling interoperation between a replacement printer cartridge and a printer of claim 14, further comprising the steps of:

programming said encrypted memory device with a set of data;

wherein said set of data is specific to a particular type of printer and is substantially similar to an original equipment manufacturer set of data except for said unique lot number data;

wherein said encrypted memory device functions as a custom original equipment manufacturer encrypted memory device and accepts all of said one or more communications from said printer except for said request for said unique lot number data.

* * * * *